United States Patent [19]

Takuma et al.

[11] Patent Number: 4,954,410

[45] Date of Patent: Sep. 4, 1990

[54] COLOR TONER COMPOSITION

[75] Inventors: Keisuke Takuma; Tsukasa Ohyama, both of Ohmuta; Isamu Ghoda, Kobe; Tamio Mikoda, Ohmuta; Hitoshi Koshida, Nishinomiya; Akitoshi Igata, Ohmuta, all of Japan

[73] Assignee: Mitsui Toatsu Chemicals, Incorporated, Tokyo, Japan

[21] Appl. No.: 315,051

[22] Filed: Feb. 24, 1989

[30] Foreign Application Priority Data

Feb. 26, 1988 [JP] Japan ..... 63-42358

[51] Int. Cl.[5] ..... G03G 9/09

[52] U.S. Cl. ..... 430/109

[58] Field of Search ..... 430/109, 107, 106

[56] References Cited

U.S. PATENT DOCUMENTS 4,391,893 7/1983 Hendriks ..... 430/137

*Primary Examiner*—John L. Goodrow

*Attorney, Agent, or Firm*—Millen, White & Zelano

[57] ABSTRACT

A novel negative charge color toner composition for electrostatic charge development having good light resistance and copy sharpness which contains, as a dyestuff in a toner resin, a 1-amino-2-phenoxy- or 2-thiophenoxy-4-hydroxyanthraquinone whose phenoxy or thophenoxy group is substituted and/or a 1,4-diamino-2,3-phenoxyanthraquinone whose phenoxy group is substitited, which can be conventionally produced.

15 Claims, No Drawings

COLOR TONER COMPOSITION

BACKGROUND OF THE INVENTION

1. Field of the Invention

The present invention relates to a color toner, particularly to a negative charge color toner composition for electrostatic charge development.

A static electron printing method and an electrophotography method are well-known methods of developing an electrical latent image with a color toner to form a visual image. Generally, in each of these methods, an electrical latent image is first formed on a photosensitive material having photoconductivity by the use of photoconductive substances and various means, and the thus formed latent image is then developed with a toner to obtain a visual image, or alternatively a dust figure is first transferred to a paper sheet or the like, if necessary, and it is then fixed by heating, pressing or a solvent vapor, thereby obtaining a visual image.

In order to obtain a multicolor image, an original is first subjected to exposure through a color separation filter, and the above-mentioned process is then repeated plural times by the use of color toners of yellow, magenta and cyan, whereby the desired color image is formed thereon.

As the toner for developing the electrical latent image, particles have heretofore been used which may be prepared by grinding, to a size of 0.1 to 50 μm or so, a binding resin such as polystyrene in which a colorant is dispersed. This kind of color toner is usually mixed with a carrier material such as glass beads or iron powder, and the thus produced color toner is used for the development of the electrical latent image.

2. Description of the Prior Art

Color toners for the development of electrical latent image must have various physical and chemical characteristics. However, most of the known color toners have the following drawbacks or do not satisfy the following requirements necessary for the color toners:

(1) The frictional electricity properties of the color toners are inversely affected by temperature change.

(2) When continuously used and repeatedly developed, color toner particles collide with carrier particles, and these particles and the photosensitive plate to which they attach themselves deterorate mutually. Consequently, a change in color density takes place or the density of the background heightens, which impairs the quality of the copies produced therefrom.

(3) When the amount of the color toner on the surface of a photosensitive plate having a latent image is increased, with the intention of heightening the density of a copy image, the background density usually also rises, with the result that the so-called fog phenomenon occurs.

(4) Since many colors are superposed upon one another, it is necessary that the color toners have good transparency.

(5) The method respective color toners are required to be excellent in miscibility.

(6) For the faithful reproduction of an original, spectral reflection properties must be good.

Most of the known color toners have one or more of the above-mentioned disadvantages or do not meet all of these requirements and thus improvement is desired.

The use of 1-amino-4-hydroxy- and 1,4-diaminoanthraquinones to provide a magenta color toner is disclosed in commonly assigned U.S. Application Ser. No. 291,896, filed 12/29/88, and the prior art discussed therein.

We have found that a certain kind of anthraquinone derivative provides a magenta color for color toners and has excellent melt miscibility, stable frictional electricity properties, high light-fastness and good transparency. Furthermore, it has been also found that when a negative charge color toner composition for electrostatic charge development containing the anthraquinone derivative as a dyestuff is utilized in performing duplication, a fog-free and sharp magenta color image can be obtained in a stable density even by repeated development for continuous duplication and the light-fastness of the thus obtained color image is also good.

An object of the present invention is to provide a novel magenta color toner composition for the electrostatic charge development containing a compound represented by the general formulae (I) and/or (II) as a dyestuff.

SUMMARY OF THE INVENTION

The present invention is directed to novel color toner compositions and to their use for electrostatic charge development, which comprises a toner binder resin singly or combinedly containing a dyestuff represented by the general formulae (I) and (II)

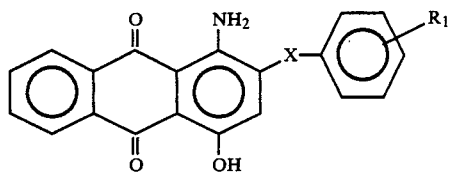

(I)

wherein X is an oxygen atom or sulfur atom, and $R_1$ is an alkyl group, an alkoxy group or an alkoxyalkoxy group, each of which may be branched, an hydroxyl group or a halogen atom, and

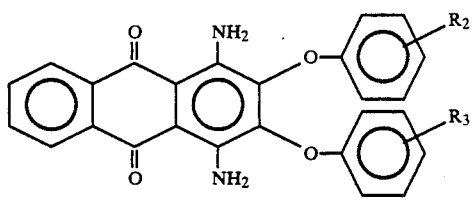

(II)

wherein each of $R_2$ and $R_3$ independently is an alkyl group, alkoxy group or an alkoxyalkoxy group, each of which may be branched, an hydroxyl group or a halogen atom.

These dyestuffs can provide negative charge properties to toners containing them. Its principle would be considered to be that an amino group or hydoxyl group which is an auxochrome of each dyestuff is combined with an acid residue in the toner resin to form a salt. Furthermore, because a substituent is present on each phenyl group in the dyestuff, the solubility of the dyestuff in the resin is heightened, so that monomolecular dispersion becomes possible, with the result that cohesion is inhibited, color density is increased, and bleed resistance is further enhanced.

DETAILED DESCRIPTION OF THE INVENTION

A color toner composition of the present invention comprises a binding resin containing therein as a dyestuff, a 1-amino-2-phenoxy-4-hydroxyanthraquinone derivative or a 1-amino-2-thiophenoxy-4hydroxyanthraquinone derivative represented by the general formula (I) and/or a 1,4-diamino-2,3-phenoxyanthraquinone derivative represented by the general formula (II).

Here, the present invention will be described with reference to preferred embodiments.

Typical examples of $R_1$, $R_2$ and $R_3$ in the general formulae (I) and (II) include straight-chain and branched alkyl groups, such as methyl, ethyl, n-propyl, isopropyl, n-butyl, t-butyl and 1,1,3,3-tetramethylbutyl; straight-chain and branched alkoxy groups, such as methoxy, ethoxy, n-propoxy, n-butoxy and t-butoxy; alkoxyalkoxy groups, such as methoxymethoxy, ethoxyethoxy and methoxyethoxy; a hydroxyl group; and halogen atoms, such as fluorine, chlorine and bromine. Particularly preferred $R_1$, $R_2$ and $R_3$ groups are branched alkyl and alkoxy of 2–10 carbon atoms. In the dyestuffs of general formula II, $R_2$ and $R_3$ are preferably the same.

Each of $R_1$, $R_2$ and $R_3$ may be at the o-, m- or p-position of the benzene ring to which they are attached but preferably are at the m- or p-position.

Each of the dyestuffs represented by the general formulae (I) and (II) can be easily prepared by a conventional process, e.g., by reacting a 1-amino-2-halogeno-4-hydroxyanthraquinone and 1,4-diamino-2,3dichloroanthraquinone respectively, as a starting material with a desired substituted phenol or substituted thiophenol in the presence of a base such as potassium carbonate.

A negative charge color toner composition containing the above-mentioned magenta dyestuff of the present invention can also be prepared by a conventional process, e.g., by grinding a binding resin dispersedly containing at least one dyestuff of the general formulae (I) or (II) in an amount of 0.1 to 10 parts by weight with respect to the binding resin in a usual manner, followed by classification and selection in order to obtain particles having a particle diameter of 0.1 to 50 mμ or so, preferably 1 to 20 μm or so.

Reference will now be made in detail to the constitutional components of the color toner compositions of the present invention.

In connection with the constitution of the color toner composition regarding the present invention, it is important that the anthraquinone dyestuff represented by the general formulae (I) or (II) is uniformly dispersed in the binding resin.

The above-defined dyestuffs provide toners produced therefrom with excellent negative charge properties and which produce red colored images. Dyestuffs represented by the general formula (I) generally produces a yellowish red image whereas dye-stuffs represented by the general formula (II) generally produce a bluish red image. Therefore, two or more of these dyestuffs can be used together as a coloring agent to produce toners according to this invention which form images of a desired magenta hue. The weight ratio of the compound of the formula (II) is generally 0.2 to 5 times, preferably 0.3 to 3 times, that of the compound of the formula (I). If a dyestuff similar to the magenta conventionally used for silver salt photography is desired, such a dyestuff can only be obtained by employing a mixture of the general formulas (I) and (II).

The amount of the dyestuff employed in a color toner depends upon the charge properties of the binding resin, an auxiliary colorant, charge properties of additives such as bis(4-tert-butyl salicylic acid)chromium II complex, N-octadecylpyridinium chloride and tetraoctylammonium chloride, miscibility with the binding resin, the manner of dispersion and the like. Therefore, the amount of the dyestuff employed is not limited to a specific weight range. However, generally speaking, the amount of the dyestuff is preferably in a concentration of about 0.1 to 10% by weight, more preferably 0.5 to 5% by weight, with respect to the binding resin.

As the binding resin to which the color toner composition of the present invention is applied, any known resin can be employed so long as it has good charge properties and is suitably miscible with a dyestuff represented by the general formula (I) or (II). Examples of suitable binding resin include homopolymers of styrene and substituted styrenes such as polystyrene, poly-p-chlorostyrene and polyvinyltoluene, styrene copolymers such as styrene-vinylnaphthalene copolymer, styrene-methyl acrylate copolymer, styrene-ethyl acrylate copolymer, styrene-butyl acrylate copolymer, styrene-octyl acrylate, styrene-methyl methacrylate copolymer, styrene-ethyl methacrylate copolymer, styrene-butyl, methacrylate copolymer, styrene-methyl α-chlorobutyl methacrylate copolymer, styrene-acrylonitrile copolymer, styrene-vinyl methyl ether copolymer, styrenevinyl ethyl ether copolymer styrene-vinyl methyl ketone copolymer, styrene-butadiene copolymer, styrene-isopropylene copolymer, styrene-acrylonitrile-indene copolymer, styrenemaleic acid copolymer and styrene-maleate copolymer, polymethyl methacrylate, polybutyl methacrylate, polyvinyl chloride, polyvinyl acetate, polyethylene, polypropylene, polyester, polyurethane, polyamide, polyvinyl butyral, polyacrylic acid resin, rosin, modified rosin, terpene resin, phenolic resin, aliphatic and alicyclic hydrocarbon resin, aromatic petroleum resin, chlorinated paraffin and paraffin wax. These compounds may be used alone or in the form of a mixture thereof.

If necessary, the color toner composition of the present invention may contain a known coloring agent as an auxiliary dyestuff, an additive to regulate charge properties, and the like.

When an electrical latent image is developed using a color toner composition of the present invention, the composition is mixed with an appropriate amount of a carrier prior to use and the resulting mixture is afterward utilized as a developing agent. Examples of the carrier include magnetic materials such as iron, cobalt and nickel, alloys and mixtures thereof. In addition, these carrier materials may be suitably coated.

The additive employed to regulate charge properties, i.e., the charge regulator is preferably a colorless compound which does not impair the quality of color display, and examples of the usable charge regulator include known compounds such as N-alkylpyridinium salts, tetraalkylammonium salts and salicylic acid chrominum complexes.

Conventional toners have some drawbacks, viz., when they are used, the light resistance of the copies produced therefrom are poor, fog phenomenon occurs and their melt miscibility is bad. In contrast thereto, the color toner composition of the present invention is a magenta dyestuff which has good light-fastness and excellent melt miscibility, and which provides stable image density even after repeated development by continuous duplication. Accordingly, it is fair to say that the color toner compositions of the present invention are extremely valuable from a commercial viewpoint.

The present invention will now be described in detail in accordance with the examples hereinafter.

Dyestuffs used in the examples were prepared by a conventional process as described above. As an example of the preparations of dyestuffs,the processes in preparing the dyestuffs used in example 1 are illustrated below. In Examples 1 to 8 and Comparative Examples 1 and 2, light resistance was evaluated by the irradiation of a Fade-meter (carbon-arc lamp) at 63° C. for 60 hours and then measurement by the use of a blue scale. The results of the light resistance are set forth in Table 1. In the examples and the comparative examples, "part" and "parts" are based on weight.

EXAMPLE OF THE PREPARATIONS

The mixture of 942 parts of p-t-butylphenol and 109 parts of potassium hydroxide was gradually heated to 150° C. Adding 140 parts of 1,4-diamino-2,3-dichloroanthraquinone to the mixture, the reaction was conducted while stirring for four hours at 190°-195° C. Thereafter the resultant mixture was cooled and discharged into 600 parts of methanol and then filtered so as to obtain the solid.

The solid was dispersed into 3000 parts of an aqueous solution of 1 wt % sodium hydroxide and stirred well. The resultant solution was filtered to obtain the solid. Subsequently, the solid was dispersed into 1000 parts of an aqueous solution of 1 wt % sodium hydroxide, then stirred and filtered to obtain the solid.

The solid thus obtained was washed with water and then dried so as to obtain 196 parts of the desired compound represented by the formula (III):

(III)

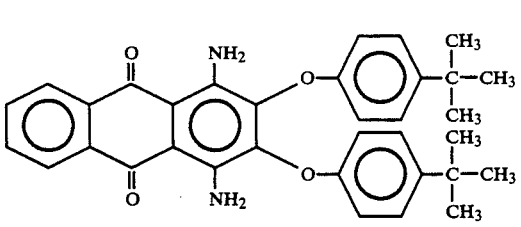

The mixture of 103 parts of p-(1,13,3- tetramethybutyl)phenyl and 4.2 parts of potassium hydroxide was heated to 110° C. 13.7 Parts of 1-amino-2-chloro-4-hydroxyanthraquinone was added to the mixture which was subsequently heated to 160° C. and kept at that temperature for 6 hours while the reaction took place. The resultant solution thus obtained was cooled to 100° C. After 80 parts of methyl cellosolve was added to the solution, it was cooled to room temperature and then filtered to obtain the solid. The solid was washed with methanol and then water, and dried so as to obtain 18.7 parts of the desired compound represented by the formula (IV):

(IV)

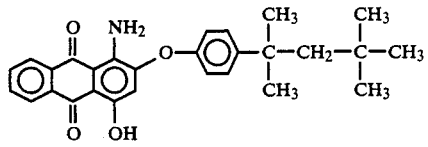

EXAMPLE 1

In a ball mill, 3.5 parts of 1,4-diamino-2,3bis(4-tert-butylphenoxy)anthraquinone represented by the formula (III)

(III)

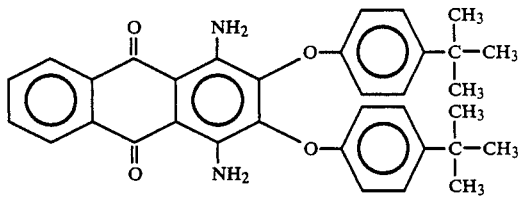

were mixed with 1.5 parts of 1-amino-2-[4-(1,1,3,3-tetramethylbutyl)phenoxy]-4-hydroxyanthraquinone represented by the formula (IV)

(IV)

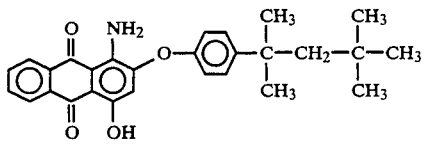

1 part of N-octadecylammonium chloride and 95 parts of a styrene-acrylate copolymer [trade name Hymer TB-1000F (Sanyo Chemicals Co., Ltd.)] resin for a toner and the resulting mixture was then ground and heated at 150° C. After melt mixing and cooling, the mixture was roughly ground using a hammer mill and was then finely ground in an air jet system mill. The particles having a diameter of 1 to 20 μm were selectively collected by classification in order to obtain the desired toner. Afterward, 10 parts of the thus-obtained toner was mixed with 90 parts of an iron powder carrier (trade name EFV250/400; made by Nippon Teppun Co., Ltd.) in order to prepare a developing agent. By the use of this developing agent, duplication was carried out through a commercial dry paper electrophotographic duplicator (trade name NP-5000; made by Canon Inc.), whereby a fog-free sharp magenta image on the copies was obtained. In addition, the light resistance of the copies was good.

EXAMPLE 2

The same procedure as in Example 1 was repeated with the exception that the magenta dyestuffs employed in the color toner composition were 3.5 parts of 1,4-diamino-2,3-bis(3-methylphenoxy)anthraquinone represented by the formula (V)

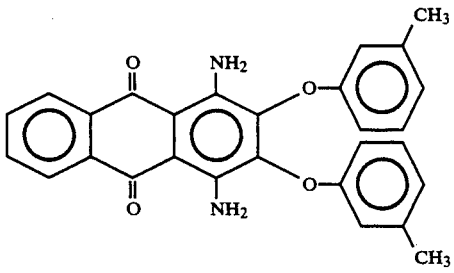

(V)

and 1.5 parts of 1-amino-4-hydroxy-2-(3-methylphenoxy)anthraquinone represented by the formula (VI):

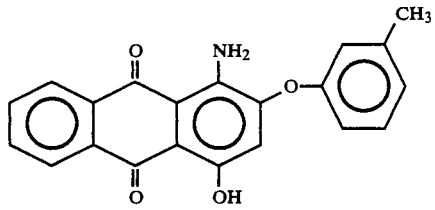

(VI)

A fog-free sharp magenta image was obtained therefrom whose light resistance was good.

EXAMPLE 3

The same procedure as in Example 1 was repeated with the exception that the magenta dyestuffs employed in the color toner composition were 3.5 parts of 1,4-diamino -2,3- bis(3-methoxyphenoxy)anthraquinone represented by the formula (VII)

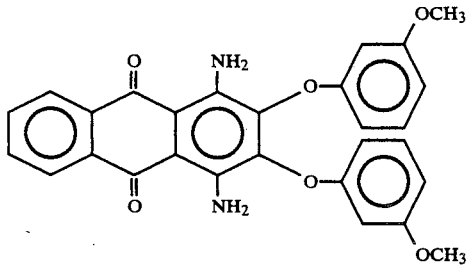

(VII)

and 1.5 parts of 1-amino-1-(4-chlorophenoxy) -4-hydroxyanthraquinone reprenseted by the formula (VIII):

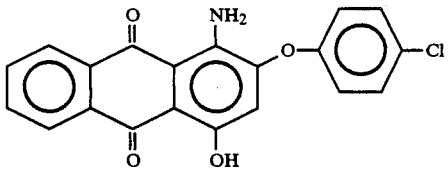

(VIII)

A fog-free sharp magenta image was obtained therefrom whose light resistance was good.

EXAMPLE 4

The same procedure as in Example 1 was repeated repeated with the exception that the magenta dyestuffs employed in the color toner composition were 3.5 parts of 1,4-diamino-3-(4-tert-butylphenoxy)-2-(4-ethoxyethoxyphenoxy)anthraquinone represented by the formula (IX)

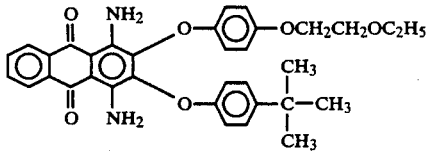

(IX)

and 1.5 parts of 1-amino-4-hydroxy-2-(3-methylthiophenoxy)anthraquinone represented by the formula (X):

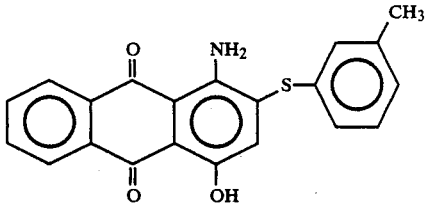

(X)

A fog-free sharp magenta image was obtained therefrom whose light resistance was good.

EXAMPLE 5

The same procedure as in Example 1 was repeated with the exception that the magenta dyestuffs employed in the color toner composition were 3.5 parts of 1,4-diamino-2,3-bis(4-chlorophenoxy)anthraquinone represented by the formula (XI)

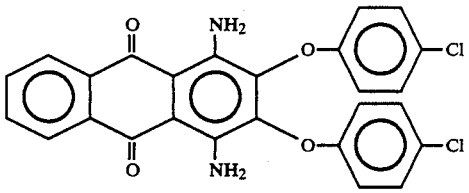

(XI)

and 1.5 parts of 1-amino-4-hydroxy-2-(4-hydroxyphenoxy)anthraquinone represented by the formula (XII):

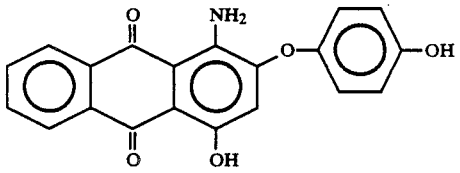

(XII)

A fog-free sharp magenta image was obtained therefrom whose light resistance was good.

EXAMPLE 6

The same procedure as in Example 1 was repeated with the exception that the magenta dyestuffs employed in the color toner composition were 3.5 parts of 1,4 -diamino-2,3-bis(4-n-octyloxyphenoxy)anthraquinone represented by the formula (XIII)

(XIII)

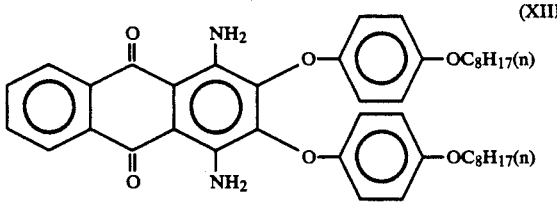

and 1.5 parts of 1-amino-4-hydroxy-2-(3-methoxyphenoxy)anthraquinone represented by the formula (XIV):

(XIV)

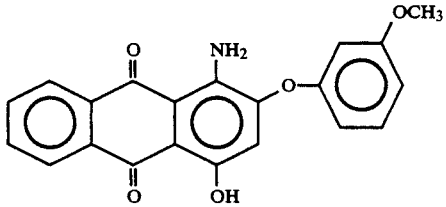

A fog-free sharp magenta image was obtained, and its light resistance was good.

EXAMPLE 7

The same procedure as in Example 1 was repeated with the exception that the magenta dyestuffs employed in the color toner composition were 4.5 parts of 1,4-diamino-2,3-bis(4-tert-butylphenoxy)anthraquinone represented by the formula (III):

(III)

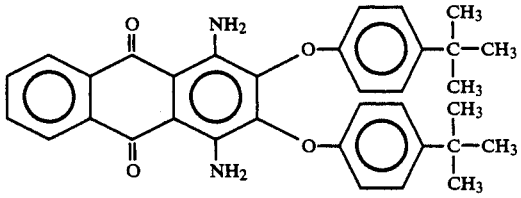

A fog-free sharp bluish magenta image was obtained, and its light resistance was good.

EXAMPLE 8

The same procedure as in Example 1 was repeated with the exception that the magenta dyestuffs employed in the color toner composition were 5.0 parts of 1-amino 2-[4-(1,1,3,3-tetra-methylbutyl)phenoxy]-4-hydroxyanthraquinone represented by the formula (IV):

(IV)

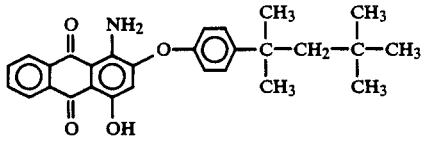

A fog-free sharp yellowish magenta image was obtained, and its light resistance was good.

COMPARATIVE EXAMPLE 1

The same procedure as in Example 1 was repeated with the exception that the magenta dyestuffs employed in the color toner composition were 5.0 parts of 2-cyclohexylthio-4-hydroxy-1-methylaminoanthraquinone represented by the formula (XV):

(XV)

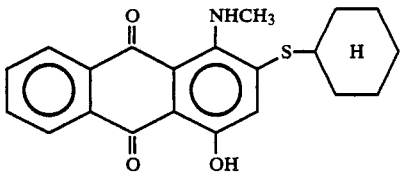

A bluish magenta image was obtained whose light resistance was bad.

COMMPARATIVE EXAMPLE 2

The same procedure as in Example 1 was repeated with the exception that the magenta dyestuffs employed in the color toner composition were 5.0 parts of 1-amino-4-hydroxy-2-methoxyanthraquinone represented by the formula (XVI):

(XVI)

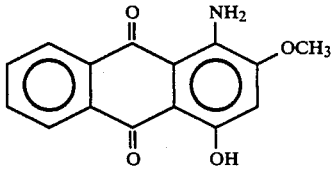

A yellowish red image was obtained therefrom whose light resistance was bad. In addition, the miscibility of the used dyestuff with the toner resin was poor and fog phenomenon occurred.

As discussed above, when diplication was carried out with toners based on the dyestuffs of the present invention as in the above-mentioned examples, fog-free sharp magenta images were obtained whose light resistance was good. However, when duplication was performed using toners based on the conventional dyestuffs as in the above-mentioned comparative examples, the light resistance of the formed images was bad and, additionally, the miscibility of the used dyestuffs with the toner resin was poor and fog phenomenon occurs.

TABLE 1

| Examples and Comp. Examples | Light Resistance |
|---|---|
| Example 1 | 6–7 |
| Example 2 | 6–7 |
| Examples 3–8 | 6–7 |
| Comp. Example 1 | 3 |
| Comp. Example 2 | 3 |

What is claimed is:

1. A color toner composition for electrostatic charge development which comprises a binding resin and at least one dyestuff having good light fastness and melt miscibility, which provides stable image density after repeated development by continuous duplication and which is represented by the general formulae (I) or (II)

(I)

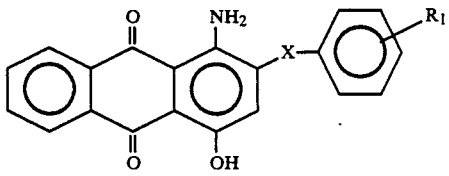

-continued

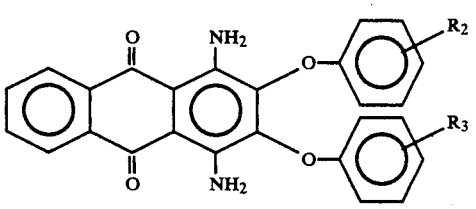

(II)

wherein X is an oxygen atom or sulfur atom, and each of $R_1$, $R_2$ and $R_3$ is an alkyl, alkoxy, alkoxyalkoxy or hydroxyl group or a halogen atom.

2. A magenta color toner composition according to claim 1 containing both a dyestuff represented by the formula (I) and a dyestuff represented by the formula (II).

3. A magenta color toner composition according to claim 1 wherein the weight ratio of said dyestuff represented by the general formula (II) is 0.2 to 5 times that of said dyestuff represented by the general formula (I).

4. A color toner composition according to claim 1 wherein the amount of said dyestuffs therein is about 0.1 to 10% by weight based on said binder resin.

5. A color toner composition according to claim 1 wherein said binder resin is a styreneacrylate copolymer.

6. A color toner composition according to claim 1 wherein each $R_1$, $R_2$ and $R_3$ group is at the m- or p-position.

7. A color toner composition according to claim 1 wherein each $R_1$, $R_2$ and $R_3$ group is alkyl or alkoxy group of 2 to 10 carbon atoms.

8. A toner composition according to claim 7 wherein each $R_1$, $R_2$ and $R_3$ group is a branched alkyl group of 3 to 10 carbon atoms.

9. A toner composition according to claim 8 wherein $R_1$ is 1,1,3,3-tetramethylbutyl and $R_2$ and $R_3$ are tert-butyl.

10. A magenta toner composition according to claim 2 wherein the weight ratio of said dyestuff represented by the general formula (II) is 0.2 to 5 times that of said dyestuff represented by the general formula (I), wherein the amount of said dyestuffs therein is about 0.1 to 10 % by weight based on said binder resin, wherein each $R_1$, $R_2$ and $R_3$ group is at the m- or p-position and each is a branched each $R_1$, $R_2$ and $R_3$ or p-position group is a branched alkyl group of 3 to 10 carbon atoms.

11. A toner composition according to claim 10 wherein $R_1$ is 1,1,3,3-tetramethylbutyl and $R_2$ and $R_3$ are tert-butyl.

12. A toner composition according to claim 1 which comprises a dyestuff represented by Formula (II).

13. A toner composition according to claim 1 which comprises a dyestuff wherein $R_2$ and $R_3$ each are a branched alkyl group of 3 to 10 carbon atoms.

14. A toner composition according to claim 1 which comprises a dyestuff of Formula (I) wherein X is S.

15. A toner composition according to claim 1 which comprises a mixture of a dyestuff of Formula (I) and a dyestuff of Formula (II).

* * * * *